United States Patent [19]

Ritchie et al.

[11] 4,260,212

[45] Apr. 7, 1981

[54] METHOD OF PRODUCING INSULATED TERMINALS

[75] Inventors: Leon T. Ritchie, Mechanicsburg; Michael S. Peppler, Lancaster, both of Pa.

[73] Assignee: AMP Incorporated, Harrisburg, Pa.

[21] Appl. No.: 22,248

[22] Filed: Mar. 20, 1979

[51] Int. Cl.[3] ..... H01R 11/12

[52] U.S. Cl. ..... 339/97 R; 29/885; 339/278 D

[58] Field of Search ..... 339/97, 98, 99, 278 D; 427/289, 290, 292; 29/885

[56] References Cited

U.S. PATENT DOCUMENTS

| | | | |
|---|---|---|---|
| 813,618 | 2/1906 | Chapman et al. | 427/289 X |
| 2,231,233 | 2/1941 | Vienhaus | 427/292 |
| 3,027,536 | 3/1962 | Pasternak | 339/97 R |
| 3,145,261 | 8/1964 | Forney | 174/84 |
| 3,345,202 | 10/1967 | Kiss | 427/289 |
| 3,728,776 | 4/1973 | Defazio | 427/292 X |
| 3,803,014 | 4/1974 | Atkinson | 204/206 |
| 3,869,373 | 3/1975 | Schacher | 204/224 M |
| 4,169,646 | 10/1979 | Stape et al. | 339/99 R |

*Primary Examiner*—John McQuade
*Assistant Examiner*—John S. Brown
*Attorney, Agent, or Firm*—Russell J. Egan

[57] ABSTRACT

A method is disclosed for manufacturing insulated electrical terminals in which the insulation is uniformly distributed over all portions of the terminal which are to be insulated. The present invention concerns a treatment of the terminal between the stages in which the terminal is initially stamped and formed and the stage in which the coating of insulation material is applied to the terminal. In this intermediate stage the terminal is subjected to a treatment which reduces any sharp edges, burrs, or the like to have radii of curvature thereby allowing the insulation coating to uniformly flow on the entire surface of the terminal.

17 Claims, 7 Drawing Figures

METHOD OF PRODUCING INSULATED TERMINALS

BACKGROUND OF THE INVENTION

1. The Field of the Invention

The present invention relates to insulated terminals and in particular to a method of producing a terminal having a uniform coating of insulation thereon.

2. The Prior Art

There are instances in the field of electrical connectors when it is desirable to have the terminals themselves coated with insulation. Examples of such insulated terminals may be found in U.S. Pat. Nos. 3,027,536; 3,145,261; and 4,169,646. In each of these instances the terminal is blanked from a die and has a number of sharp substantially 90° corners between each surface and edge of the terminal. As the tooling producing the terminals becomes worn or misaligned there can also be burrs formed on the edges of the terminal as well as other irregularities. In most normal terminal functions these conditions and sharp edges present no serious problems.

When one attempts to coat terminals of the above type, problems do arise since the rough edges, burrs, and sharp corners cause obstacles to providing a uniform coating of insulation. In fact, extremely erratic results can be produced by these non-uniform edges. Most terminals thus coated will have gaps or insufficient insulation thickness which can result in shorting of the terminal instead of the desired insulating effect. It was discovered that varying the material for the insulating coating, the thickness of the coating, and even the manner in which the coating is applied had little effect on improving the overall coating since the exposed edges, burrs, and the like still penetrated the coating layer.

SUMMARY OF THE INVENTION

The subject invention overcomes the above mentioned difficulties by providing an intermediate step between the forming of the terminal and the application of an insulating coating thereto. The intermediate step of the invention constitutes subjecting at least that portion of the terminal which is to be insulated to a reducing medium which will remove irregularities in the surfaces and edges of the terminals and will reduce sharp edges to curved transitions between surfaces. This reducing step can be accomplished by either chemical or mechanical means such as, for example, chemical etching and mechanical abrasion by loose particles.

It is therefore an object of the present invention to produce an improved electrical terminal having a uniform coating of insulation over at least a portion thereof.

It is another object of the present invention to teach a method by which a terminal can be pretreated to have a uniform coating of insulation deposited over at least a portion thereof.

It is still another object of the present invention to teach an intermediate step in the production of electrical terminals in which each terminal is subjected to a reducing process whereby surface irregularities and sharp edges are removed.

It is a further object of the present invention to teach the pretreatment of an electrical terminal by mechanically or chemically reducing irregularities and sharp edges on those portions of the terminal which are to be subsequently coated with insulative material.

It is a still further object of the present invention to teach a method which can be used to improve an insulated electrical terminal without substantially adding to the manufacturing costs thereof.

It is yet another object of the present invention to produce an insulated electrical terminal by a ready and economic means.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
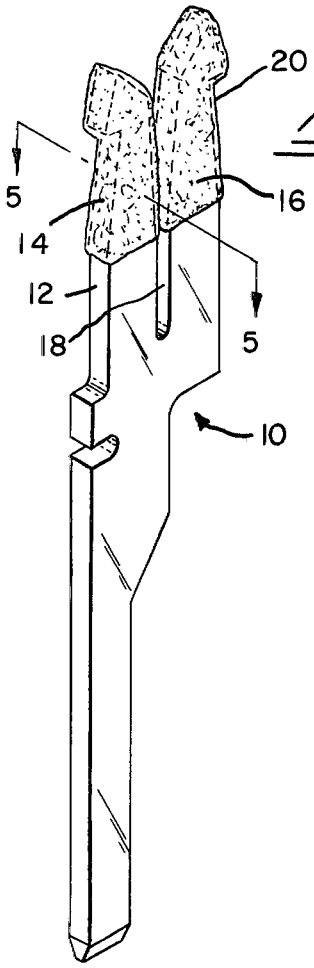
FIG. 1 is a perspective view of a known insulation piercing terminal that has a portion coated with an insulative material.

FIG. 1 shows an insulation piercing terminal 10 of the type disclosed in U.S. Pat. No. 3,820,055, the disclosure of which is incorporated herein by reference. This terminal 10 has an insulation piercing end portion 12 formed by a pair of tines 14, 16 defining a slot 18 therebetween. The insulation piercing end portion 12 has been coated by a layer of insulative material 20. This terminal can be utilized to penetrate a multi-layered cable to make electrical and mechanical contact with conductors received within the slot 18 while insulation 20 prevents contact with conductors of other layers of the cable.

Figure 2:
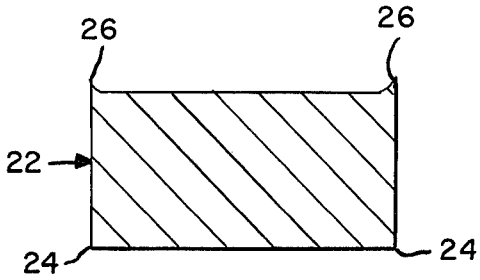
Fig. 2 PRIOR ART
FIG. 2 is a section view through a portion of a typical prior art terminal.
Figure 3:
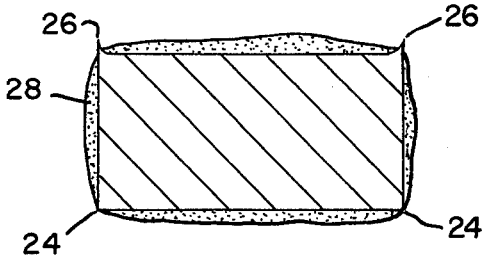
Fig. 3 PRIOR ART
FIG. 3 is a section view, similar to FIG. 2, showing a portion of a prior art terminal coated with an insulative material.

FIGS. 2 and 3 show a typical section through a known terminal 22 which was formed in the conventional manner of the prior art. This section shows the terminal as having sharp corners 24 and burrs 26, both of which are a product of the way in which the terminal 22 is manufactured. When this terminal has a coating of insulation 28 applied thereto, by any known means, it will be noted that the sharp edges 24 and burrs 26 will prevent the uniformed distribution of the insulation 28 thereon so that there is the substantial probability that edges 24 and burrs 26 will penetrate through the insulation 28 at some point in the coating.

Figure 4:
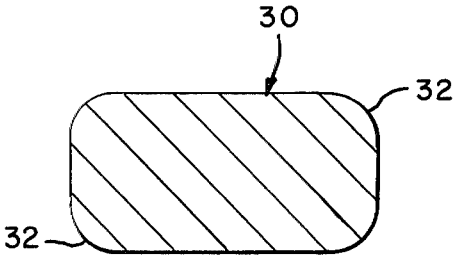
FIG. 4 is a section view through a terminal which has had the surface reduction treatment of the present invention.
Figure 5:
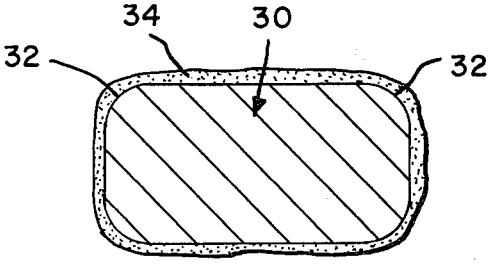
FIG. 5 is a section view of the terminal of FIG. 4 after coating with a layer of insulation.

The terminal 30 of FIGS. 4 and 5 has been subjected to the pretreatment of the present invention so that the original corners 24 have been reduced to smooth transitional curves 32 and likewise burrs and other irregularities have been removed. It is then possible for the insulative coating 34 to uniformly flow over the surface of the terminal.

Figure 6:
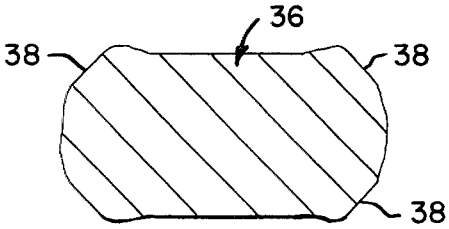
FIG. 6 is a section view of a terminal which has had the sharp corners reduced by a swaging or stamping operation.
Figure 7:
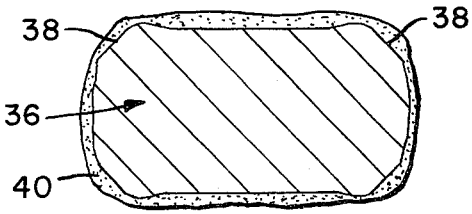
FIG. 7 is a section view of the terminal of FIG. 6 after coating with a layer of insulation.

The terminal 36 of FIGS. 6 and 7 has been subjected to a further stamping or swaging operation so that the original corners and burrs are reformed into angular transition surfaces 38. It is possible to achieve a uniform coating of the insulation 40 in this embodiment since the sharp corners and irregularities are reduced. It will be noted that this operation slightly deforms the side walls of the section but to no detrimental extent.

The intermediate step of the present invention can be accomplished by a number of reducing methods. For example, chemical etching in a ferric chloride bath is sufficient to reduce the burrs and corners to accept a uniform coating. The same or similar results can be obtained by use of other chemical compounds as well as by electropolishing. Examples of acceptable chemical deburring methods can be found in U.S. Pat. Nos. 3,803,014 and 3,869,373. Mechanical means and methods, including coining of the blanked terminal as well as mechanical abrasive removal of the irregularities, such as by sand blasting, can also be used to effect the necessary surface reduction.

The coating of insulation can be applied to the thus prepared terminals by any of the well known means including powder coating, dipping into liquid baths, spraying, plating and electrodeposition.

The coating material can be selected from any of the well known dielectric materials, such as vinyls, enamels, urethane, epoxys, polyesters, nylons, polypropylenes, acrylics, butyrates, and propionates.

The present invention may be subject to many modifications and changes without departing from the spirit or essential characteristics thereof. The present embodiments are therefore to be considered in all respects as illustrative and not restrictive of the scope of the invention.

What is claimed is:

1. A method of producing insulated electrical terminals comprising the steps of:

stamping a continuous series of terminals from a flat web of metal stock, each said terminal having at least one insulation piercing portion;

subjecting all of said at least one insulation piercing portion of said terminal to an erroding medium which reduces all sharp edges of said portion to radii of curvature; and applying a coating of insulative material to said portion of said terminal.

2. A method according to claim 1 wherein said erroding medium is chemical in nature.

3. A method according to claim 1 wherein said erroding medium is chemical etching.

4. A method according to claim 1 wherein said erroding medium is electropolishing.

5. A method according to claim 1 wherein said erroding medium is mechanical in nature.

6. A method according to claim 1 wherein said erroding medium includes subjecting at least said insulation piercing portion of each said terminal to a jet of abrasive material.

7. A method of producing an electrical terminal having an insulation piercing portion with a coating of insulation at least partially covering said portion, said method comprising the steps of:

forming a continuous series of terminals from a web of metal stock material, each said terminal having an insulation piercing portion;

reducing all sharp edges, projections, burrs and the like on at least said insulation piercing portion of said terminal to curved surfaces of transition; and coating said insulating piercing portion of said terminal with a dielectric material.

8. A method according to claim 7 wherein:

said terminal is die formed.

9. A method according to claim 7 wherein said dielectric material is selected from the group consisting of vinyls, enamels, epoxys, urethane, polyesters, nylons, polypropylenes, acrylics, butyrates, and propionates.

10. A method according to claim 7 wherein said coating step is carried out by dipping, spraying, plating or electrodeposition.

11. A method according to claim 7 wherein said reducing is accomplished by chemical means.

12. A method according to claim 7 wherein said reducing is accomplished by mechanical means.

13. An improved, partially insulated electrical terminal having a coating of insulation at least partially covering an insulation piercing portion of said terminal, said terminal being produced by the steps of:

forming a continuous series of terminals from a web of metal stock material, each terminal having at least one insulation piercing portion;

reducing all sharp edges, projections, burrs and the like on said at least one portion of said terminal to curved surfaces of transition; and coating said at least one portion of said terminal with a dielectric material.

14. The terminal according to claim 13 wherein:

said reduction of sharp edges, projections, burrs and the like is accomplished by chemical means.

15. The terminal according to claim 13 wherein:

said reduction of sharp edges, projections, burrs and the like is accomplished by mechanical means.

16. The terminal according to claim 13 wherein said dielectric material is selected from the group consisting of vinyls, enamels, epoxys, urethane, polyesters, nylons, polypropylenes, acrylics, butyrates, and propionates.

17. The terminal according to claim 13 wherein said coating step is carried out by dipping, spraying, plating or electrodeposition.

* * * * *